US005584302A

United States Patent [19]

Sillaway et al.

[11] Patent Number: 5,584,302

[45] Date of Patent: Dec. 17, 1996

[54] SURGICAL FRAME PAD COVER

[75] Inventors: Ina Sillaway, Granbury, Tex.; Glena McComb, Laurel, Miss.

[73] Assignee: Devon Industries, Inc., Chatsworth, Calif.

[21] Appl. No.: 413,860

[22] Filed: Mar. 28, 1995

[51] Int. Cl.[6] ..... A47G 9/00

[52] U.S. Cl. ..... 128/845; 128/DIG. 15

[58] Field of Search ..... 128/845, 846, 128/849–856, DIG. 18, DIG. 15; 5/490; 206/315.1; 224/309

[56] References Cited

U.S. PATENT DOCUMENTS

| | | | |
|---|---|---|---|
| 4,506,396 | 3/1985 | Ritchie | 5/631 |
| 4,715,416 | 12/1987 | Horne | 206/315.1 |
| 5,311,882 | 5/1994 | Gagne | 128/845 |

OTHER PUBLICATIONS

Wilson Spinal Surgery Frame, RWF–1000 Brochure, 1 page (1993).

Comfortex Brochure, 4 pages.

OSI Jackson Spinal Surgery & Imaging Table JST–2000 Brochure, 6 pages (1991).

*Primary Examiner*—Sam Rimell

*Attorney, Agent, or Firm*—Lyon & Lyon

[57] ABSTRACT

A pad cover for a Wilson Spinal Surgery Frame includes a first section spaced apart from a second section, and joined to the second section by a bridge. The first and second sections are foam rubber and substantially rectangular. The pad cover is preferably attached to the Wilson Frame using Velcro hook and loop tape. The pad cover may be provided in a kit which also includes a kneeling pad and attachment tape strips. The pad cover increases patient comfort by cushioning the patient's torso and by avoiding having the patient rest on tape or other uncomfortable surfaces.

14 Claims, 4 Drawing Sheets

Fig. 1
(PRIOR ART)
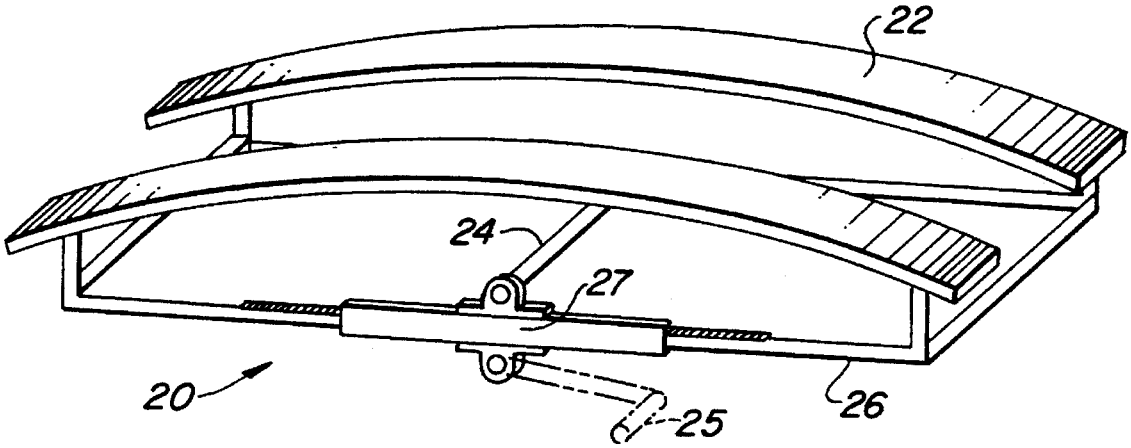
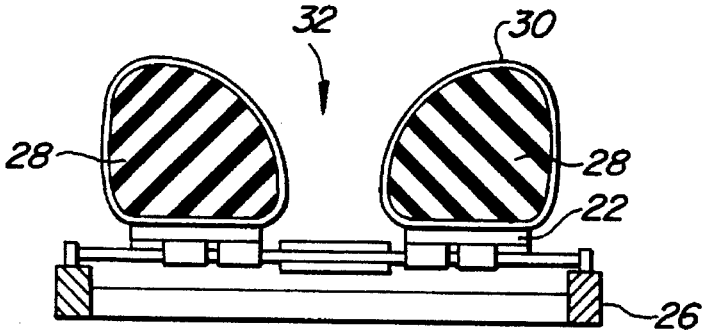
Fig. 2
(PRIOR ART)
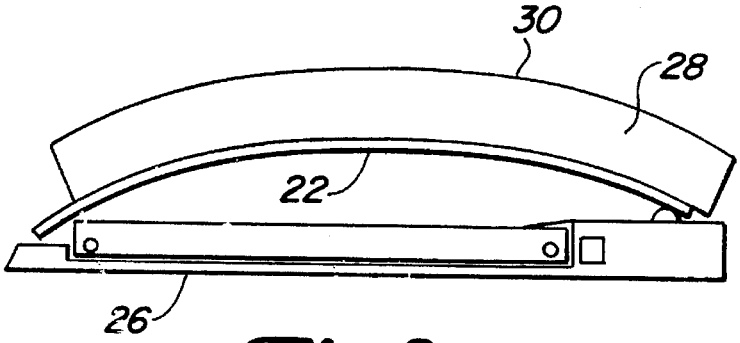
Fig. 3
(PRIOR ART)

SURGICAL FRAME PAD COVER

BACKGROUND OF THE INVENTION

Surgical frames and positioners are often used to hold a patient, or the patient's limbs or torso, in position during a surgical procedure. The Wilson Spinal Surgery Frame, manufactured by Orthopedic Systems, Inc., Union City, Calif., is one type of surgical frame. The Wilson Frame is often used to perform spinal surgery. With the patient lying prone and face down on the flat frame, the frame is then typically cranked into an arched shape causing the patient's vertebrae to separate, to better facilitate certain spinal operations. The Wilson Frame can also be used for other procedures.

The Wilson Frame, as shown in FIGS. 1–4, includes a metal frame 20 having a pair of spaced apart panels 22, supported on a frame base 26. A cross bar 24 is part of the frame base 26 and extends laterally below the panels 22. As shown in FIG. 2, frame pads 28 are attached to the panels 22, often using belts. The frame pads 28 are firm and typically have a vinyl cover 30. The left and right frame pads 28 and panels 20, as shown in FIG. 2, are spaced apart to create a space 32 for the patient's abdomen. A crank handle 25 is used to crank a drive mechanism 27 on or in the frame base 26 to raise up or bow the frame.

Referring to FIG. 4, in a typical use, a headrest 36 supports the patient's head. Pillows 38 may be placed under the patient's feet. The entire surgical frame 20 is supported on a cart 34. Thin disposable tubular frame pad liners or covers can be positioned over or around the frame pads.

While the Wilson Frame 20 has been used successfully, it often can cause patient discomfort, as the patient's torso is supported on the spaced apart frame pads 28, which have inclined or angled inside facing surfaces. Accordingly, there remains a need for an improved surgical frame.

SUMMARY OF THE INVENTION

To these ends, a pad cover for surgical frame (e.g., a Wilson Spinal Surgery Frame) preferably includes a first section, a second section spaced apart from the first section, and a bridge section joining the first section and the second section. The first and second sections are advantageously attached to the frame by tape, hook and loop fastener strips, etc. Preferably, the first and second sections are made of foam rubber, to provide cushioning for the patient's torso. To advantageously fit onto a Wilson Frame, the first and second sections are rectangular, and the spacing between them matches the spacing between the frame pads on the Wilson Frame. The present frame pad cover, in one preferred embodiment, may be provided as a kit, with the kit including the pad cover, attachment belts or Velcro hook and loop strips, one or two additional T-shaped pads to cushion the patient's knees or upper chest.

Accordingly, it is an object of the invention to provide a surgical frame pad cover, and an improved surgical frame.

BRIEF DESCRIPTION OF THE DRAWINGS

Other objects and features of the present invention will become apparent from the following detailed description taken in connection with the accompanying drawings, which disclose several embodiments of the invention. It is to be understood, however, that the drawings are designed for the purpose of illustration only and are not intended as a definition of the limits of the invention.

In the drawings, wherein similar reference characters denote similar elements throughout the several views:

FIG. 1 is a perspective view of a Wilson Spinal Surgery Frame, without the frame pads attached and in the up or bowed position;

FIG. 2 is a partial section view of a Wilson Spinal Surgery Frame showing the frame pads attached to the panels, with the frame in the down or flat position;

FIG. 3 is a schematically illustrated side elevation view of a Wilson Spinal Surgery Frame with the frame pads attached;

DETAILED DESCRIPTION OF THE PREFERRED EMBODIMENTS

Figure 7:
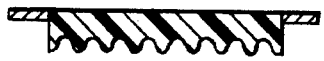
FIG. 7 is a section view taken along lines 7—7 of FIG. 5.
Figure 6:
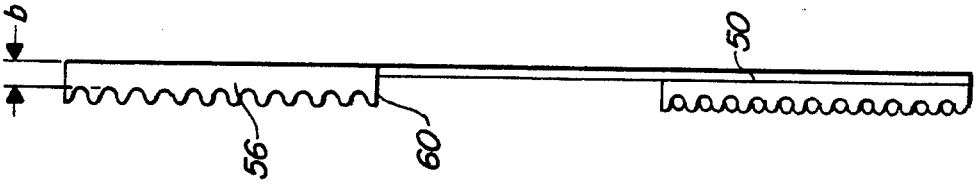
FIG. 6 is an end view thereof.
Figure 5:
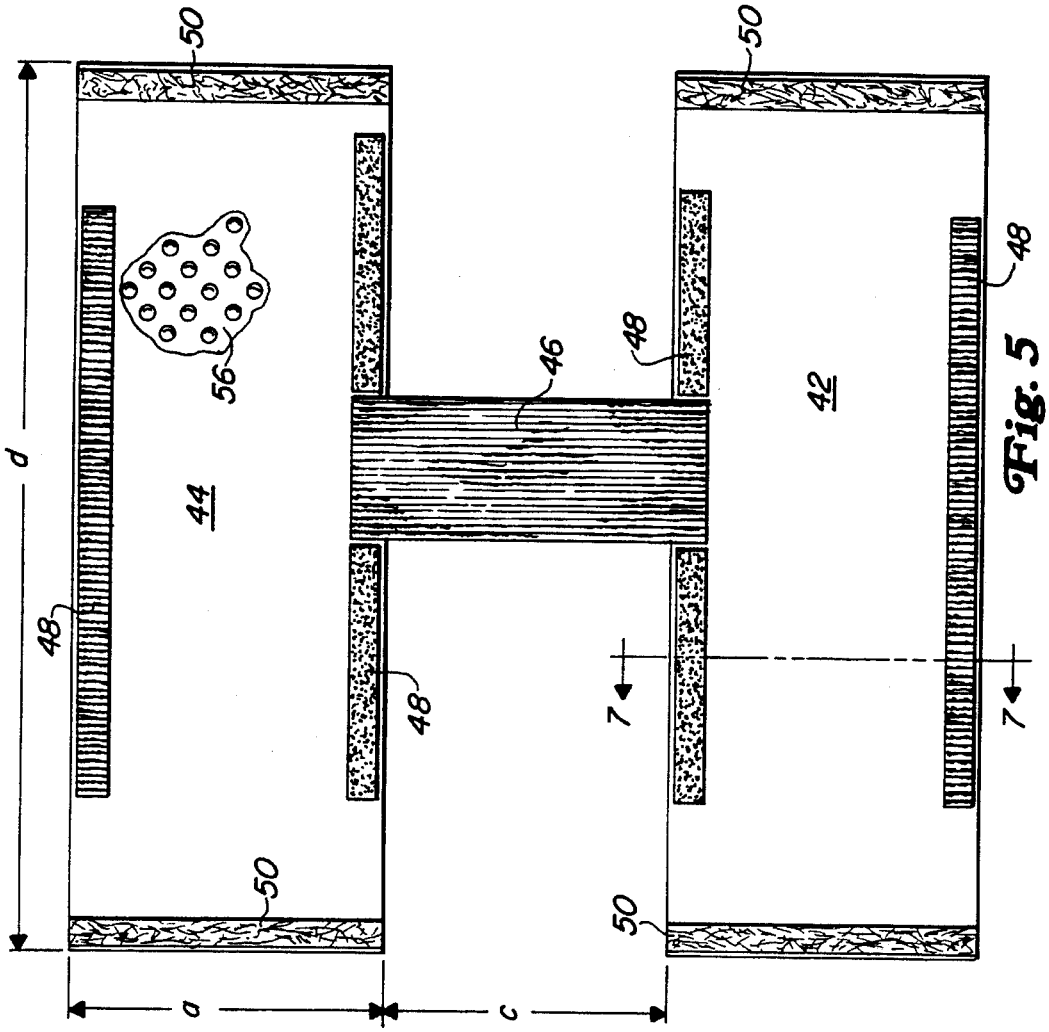
FIG. 5 is a plan view of the present pad cover.

Turning now in detail to the drawings, as shown in FIG. 5, the present pad cover 40 includes a first section 42 joined to a second section 44 by a bridge 46. As shown in FIG. 7, first and second sections are preferably made of egg crate style or convoluted foam rubber. Preferably, the peaks 56 of the foam rubber are about 2½ inches high, with a base "b", as shown in FIG. 6, of about ¾ of an inch. The bridge section 46 is made thinner, preferably about ¼ inch thick foam strip, as it serves to connect the first and second sections and cover the cross bar 24.

The pad cover 40 is dimensioned to fit onto the Wilson Frame 20. Accordingly, as shown in FIG. 5, the first and second sections are rectangular and have substantially the same dimensions: a width "a" of about 9 inches; a length "d" of about 33 inches and a spacing between the first and second sections "c" of about 18 inches.

Figure 8:
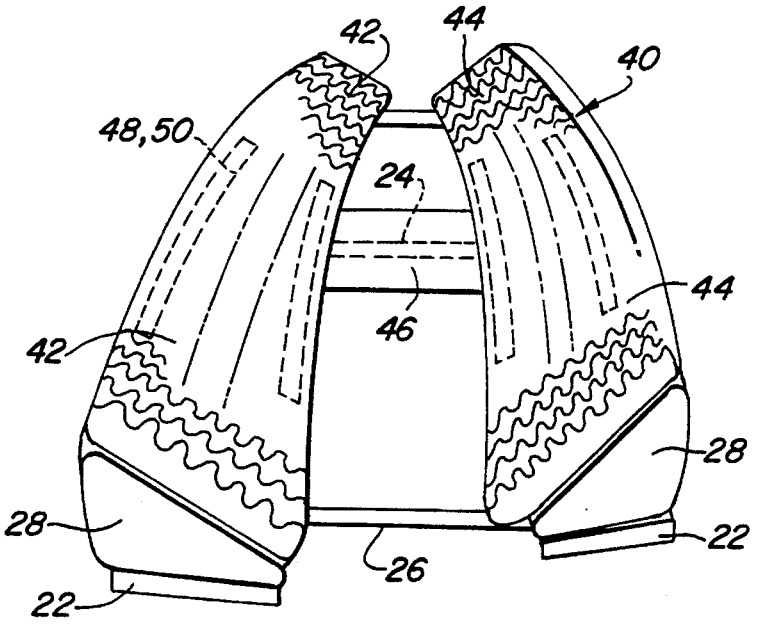
FIG. 8 is a perspective view of the present pad cover installed on a surgical frame.

Fastener strips, such as (Velcro) hook and loop tape strips are attached to the first and second sections 42 and 44. In use, the pad cover 40 is placed over the frame pads 28 with the fastening strips 48 and 50 used to secure the first and second sections onto the frame pads 28 of the frame 20.

Where hook and loop fastener tape is used, one side of the tape, e.g., the loop tape 48 may be permanently bonded or attached to the frame pads 28. In that event, for each surgical procedure, a new pad cover 40 is attached using the counterpart fastener tape (e.g., hook tape 50) provided on the pad cover 40. Alternatively, both sides of hook and loop fastener tape 48 and 50 can be provided with the pad cover 40, with one side of the fastener tape applied to the frame pads 28 during the setup for each surgical procedure. The tape or strips at the ends are optional. Preferably, one side of the strip has an adhesive back, to attach the strip to the frame pads 28. The mating strip is attached permanently to the first and second sections 42 and 44 during manufacture. The pad cover 40 is temporarily attached to the frame pads during the surgical operation by engaging the two strip sections. As shown in FIG. 8, the pad cover provides a comfortable padded surface for the patient's torso on the spaced apart, angled and arched frame pads 28.

Figure 4:
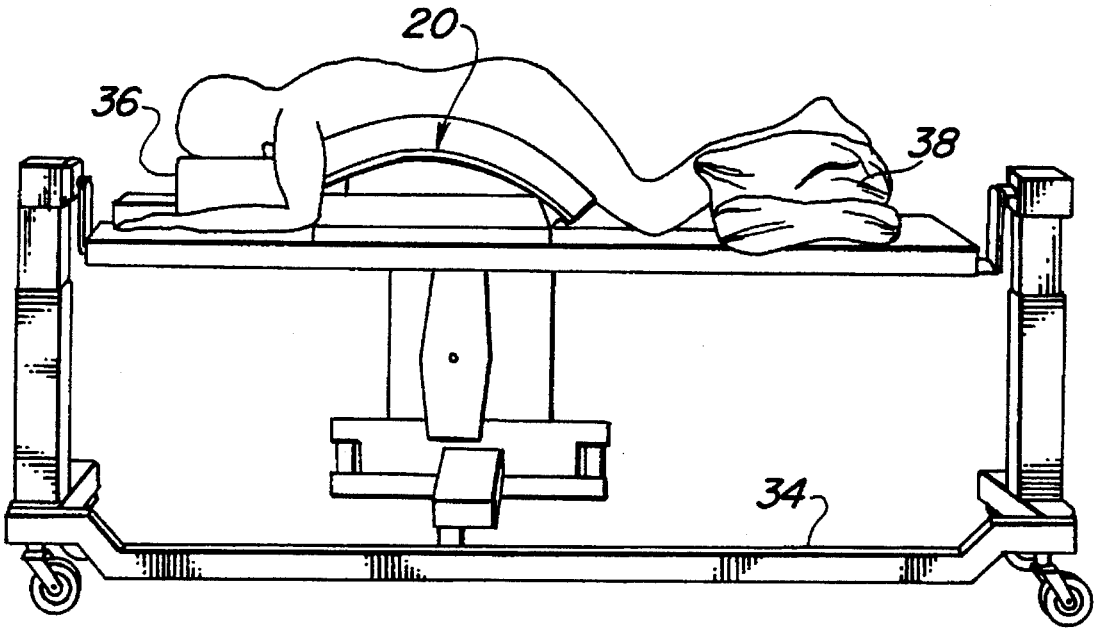
Fig. 4 (PRIOR ART)
FIG. 4 is a perspective view of a Wilson Frame in use.
Figure 9:
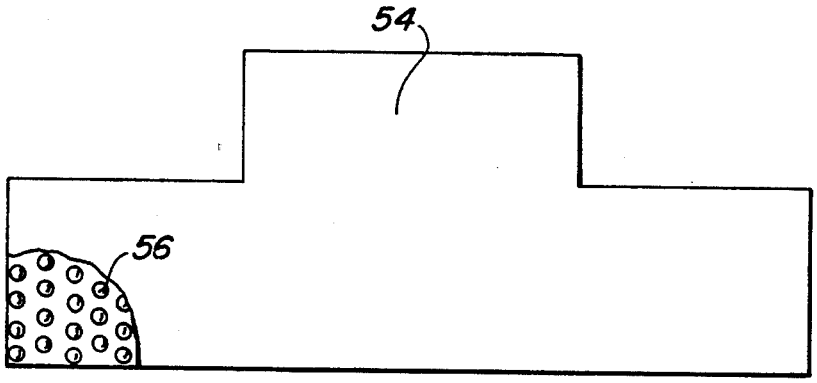
FIG. 9 is a plan view of a T-pad.
Figure 10:
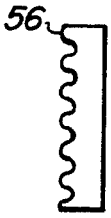
FIG. 10 is an end view thereof.

Referring to FIGS. 9 and 10, a T-shaped pad 54, having a truncated T-shape may be provided with the pad cover 40 in a kit. The pad 54, in use, is positioned underneath the patient's knees (reference FIG. 4), so that the patient's torso and knees are both cushioned. A second pad 54 can be placed under the patient's upper chest.

The Wilson Frame and pad cover can also be used for other surgical procedures, and the pad cover 40 potentially used on other types of surgical frames. When the pad cover 40 is installed, using a hook and loop tape, as shown in FIG. 5, patient comfort is improved by providing cushioning and also because no tape or other uncomfortable surfaces contact the patient.

Thus, while several embodiments of the present invention have been shown and described, many changes and modifications may be made without departing from the spirit and scope of the invention.

We claim:

1. In a surgery frame of the type having a pair of spaced apart reusable frame pads, the improvement comprising:

a disposable frame pad cover adapted to be temporarily placed over the frame pads during a surgical procedure, including:

a first section;

a second section;

a bridge section joining the first section and the second section; and attachment means for attaching the first and second sections to the surgery frame.

2. The pad cover of claim 1 wherein the first section and the second section comprise foam rubber.

3. The pad cover of claim 1 wherein the first section and the second section are substantially rectangular.

4. The pad cover of claim 1 wherein the attachment means comprises hook and loop fastener tape.

5. The pad cover of claim 1 wherein the first section and the second section have approximately equal widths.

6. The pad cover of claim 1 wherein the first section is spaced apart from the second section by approximately twice the width of the first section.

7. The pad cover of claim 1 wherein the first section has a length and a width approximately equal the length and width of the second section.

8. The pad cover of claim 1 wherein the first section and the second section each have a length of approximately 33 inches and a width of approximately 9 inches.

9. An apparatus for supporting a patient, comprising:

a Wilson Spinal Surgery Frame;

a pair of spaced apart frame pads attached to the Wilson Spinal Surgery Frame; and a disposable pad cover removably attached to the frame pads, with the disposable pad cover including a first section, a second section, and a bridge section joining the first and second sections, and with the first and second sections each overlying one of the pair of frame pads.

10. The apparatus of claim 9 wherein the Wilson Frame has a cross bar and the bridge section covers the cross bar.

11. The apparatus of claim 9 further comprising hook or loop tape fastener tape on the frame pads for removably attaching the disposable pad cover onto the frame pads.

12. A kit for use with a surgical frame, comprising:

a frame pad cover having a first section spaced apart from a second section, and attached to the second section by a bridge section;

a kneeling pad having a truncated T-shape; and means for attaching the frame pad onto the surgical frame.

13. The kit of claim 12 wherein the frame pad is dimensioned to fit onto a Wilson Surgical Frame.

14. A pad cover for a surgery frame comprising:

a first section and a second section comprising egg crate style foam rubber material having peaks of approximately 2½ inches in height and a base of approximately ¾ of an inch;

a bridge section joining the first section and the second section; and attachment means for attaching the first and second sections to the surgery frame.

* * * * *